United States Patent [19]

Krepp

[11] Patent Number: 5,046,760

[45] Date of Patent: Sep. 10, 1991

[54] GENERAL PURPOSE CLIPBOARD

[76] Inventor: Charles M. Krepp, 7868 Lowtide Cir., Huntington Beach, Calif. 92648

[21] Appl. No.: 451,613

[22] Filed: Dec. 18, 1989

[51] Int. Cl.[5] ..... B42D 3/00

[52] U.S. Cl. ..... 281/45; 206/309

[58] Field of Search ..... 24/67.11, 312; 281/45; 206/309, 310, 311, 224; D6/406, 420, 419

[56] References Cited

U.S. PATENT DOCUMENTS

| | | | |
|---|---|---|---|
| 302,774 | 7/1884 | Polkinhorn | 281/45 |
| 4,747,484 | 5/1988 | Ackeret | 206/309 |

*Primary Examiner*—Paul A. Bell

*Attorney, Agent, or Firm*—Michael R. Collins

[57] ABSTRACT

A new version of a clipboard comprising of a single piece construction with a top panel and a bottom panel so joined that between are hollow cavities designed to hold drafting aids. The top surface provides a smooth drawing surface on the upper side and a clip to secure paper.

5 Claims, 2 Drawing Sheets

GENERAL PURPOSE CLIPBOARD

BACKGROUND OF THE INVENTION

1. Field of the Invention

The technical field of the General Purpose Clipboard pertains to those device which use a solid flat surface which can be used to write and draw on and upon which papers can be clipped as not to be loose.

2. Description of Prior Art

Currently used clipboards have a clipping mechanism at the top. These boards clamp paper and provide a hard flat surface to write upon. The primary advantage of the clipboard is to allow a person to write in situations where there are no suitable surfaces. An example is when a person is standing or sitting in a chair. These clipboards are limited since they serve no other purpose than to provide a flat surface while it is sometimes desirable to have a number of accessories to assist the user in situations which require more than just writing.

SUMMARY OF OBJECTIVES OF THE INVENTION

The General Purpose Clipboard is a combination of a standard design clipboard with recesses between a top and bottom surface where accessories can be stored. This form of the clipboard enables the user to carry and use accessories such as rulers and protractors with a minimum increase in clipboard thickness. Accessories include various items like protractors, rulers, stencils, paper and templates.

In accordance with the description presented other objects of this invention will become apparent when the description and drawings presented are reviewed.

DESCRIPTION OF THE PREFERRED EMBODIMENT

Figure 1:
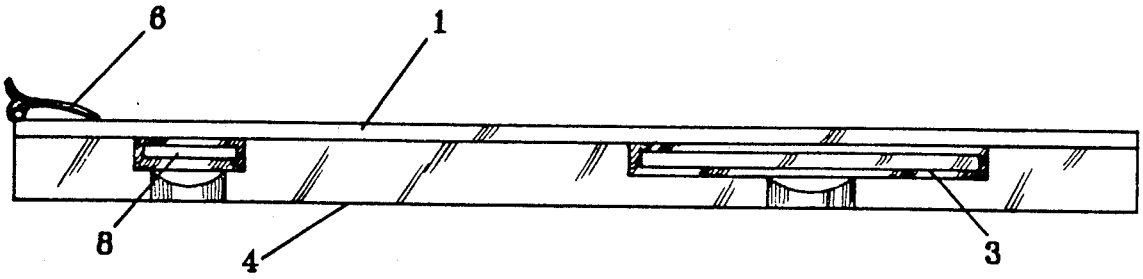
FIG. 1: Illustrates a side view of the general purpose clipboard.
Figure 2:
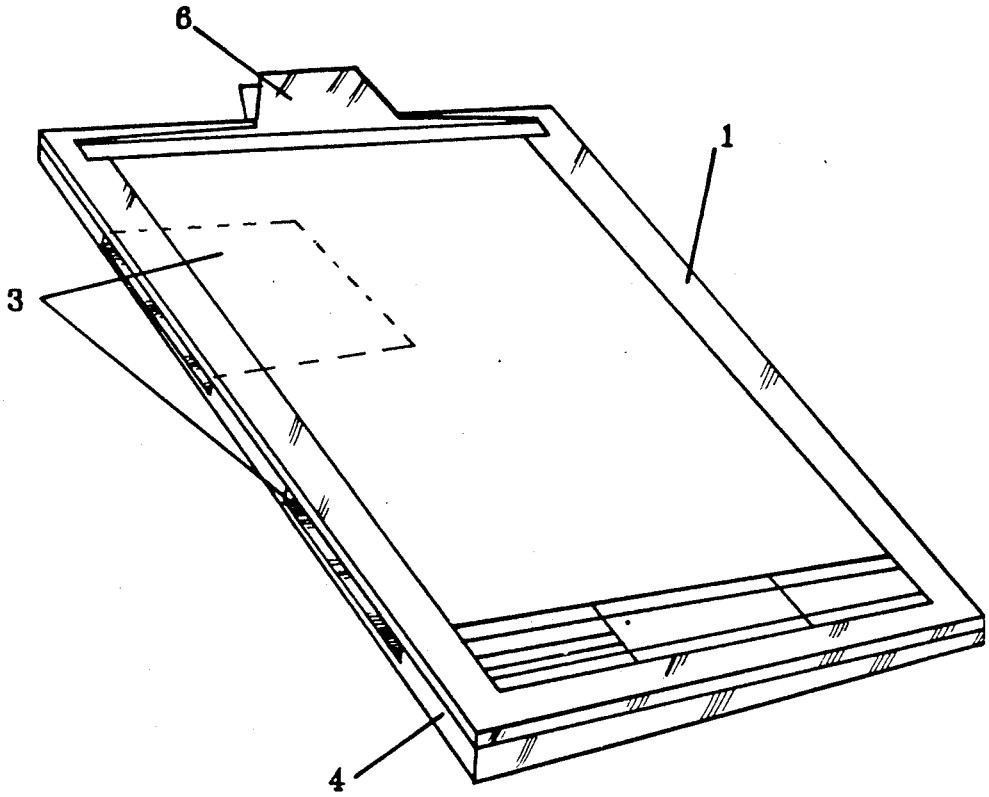
FIG. 2: Illustrates a perspective view of the device.
Figure 3:
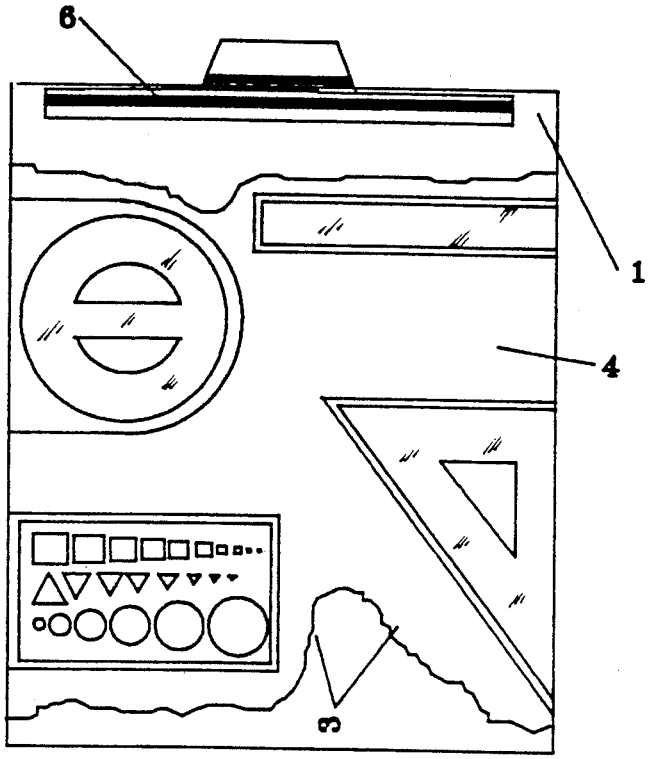
FIG. 3: Illustrates a top view of the device.
Figure 5:
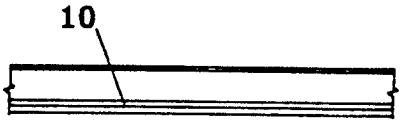
FIG. 5: Illustrates an end view of the device with a material coating on the inner surface.
Figure 6:
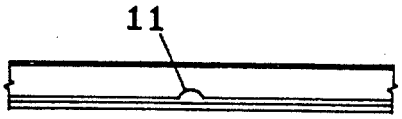
FIG. 6: Illustrates an end view of the device with a detent on the inner surface.

Referring to FIGS. 1, 2, 3, and 4 the figures represent preferred embodiments for carrying out the invention.

The General Purpose Clipboard is comprised of two major components, a top surface (1) and a bottom panel (4). The top surface (1) and bottom surface (4) are integrally joined to form one piece.

In use, the practical size of the bottom surface (4) is nine inches by fourteen inches. The bottom surface (4) is constructed of formed plastic with a number of indentions (3) for holding items like protractors, and templates. The bottom surface (4) is one fourth inch thick with the cavity indention three sixteenths inch deep. This allows enough space for the items to be easily slid into the cavity (3). The indention is placed to allow the accessory to be placed or removed from the side of the clipboard.

Figure 4:
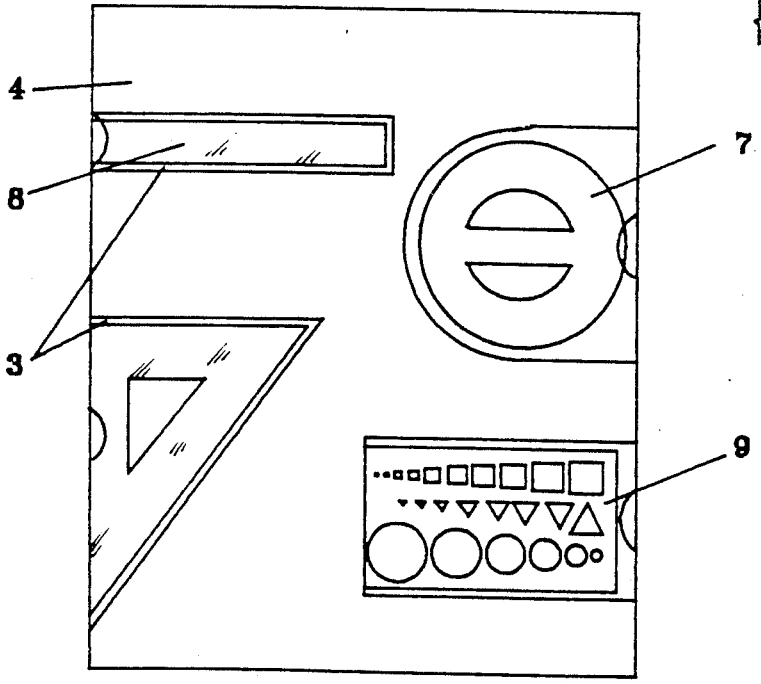
FIG. 4: Illustrates the device without the top panel of the clipboard.

The top surface (a) is a solid piece of plastic hard enough to write on. The cavities (7), (8), (9) are of a size that allows the accessory to fit tightly as it is slid into position, a detect (11) or other method of keeping the item firmly in place may be used. The detent (11) is a slightly raised portion of the interior side of either the top surface (1) or bottom surface (4) of sufficient height to apply force into the item stored in the indentation to keep the item from sliding out. Another method of retaining the item is to coat the interior surfaces of either the top surface (1) or bottom surface (4) with material (10) that would prevent the item inserted from slipping out. The top surface (1) and bottom surface (4) as shown in FIG. 4 are transparent allowing for easy viewing. A slight cutout to allow grasping the accessory is cutout of the surface (4).

On the top surface (1) at the top is a standard clip device as used in commonly used clipboards.

As a unit the General Purpose Clipboard is useful and convenient for use when walking or when away from a desk especially when accessories like protractors, straight edges, and templates are needed.

I claim:

1. An improved clipboard comprising:

a. a panel having a flat bottom surface;

b. a panel having a top surface which is a hard and smooth surface to draw on;

c. a means of attachment between the panel having a flat bottom surface and panel having a top surface shaped wherein cavities are formed between the two surfaces and the cavities are of sufficient size and shape to allow drawing aids to be stored in the cavity and having the cavity located such that the aid may be withdrawn by extracting the aid from between the top surface and bottom surface;

d. a standard clipping mechanism at top of the panel having a top surface to hold papers in place; and e. The drawing aids comprise a straight edge, protractor, template and triangle.

2. An improved clipboard as in claim 1 wherein the underside of the panel having a top surface has a coating to prevent the accessories from sliding and making noise.

3. An improved clipboard as in claim 1 wherein a cutout from the bottom surface allows grasping of the accessory with a finger.

4. An improved clipboard as in claim 1 wherein a detent is formed in the cavity to prevent the accessory from falling out of the cavity area.

5. As in claim 1 wherein the panel having a top surface is transparent.

* * * * *